US007331119B2

(12) United States Patent
Perry et al.

(10) Patent No.: US 7,331,119 B2
(45) Date of Patent: Feb. 19, 2008

(54) APPARATUS AND METHOD THERMALLY REMOVING COATINGS AND/OR IMPURITIES

(76) Inventors: Ophneil Henry Perry, 12 Mardale Close, Nottingham NG2 6SW (GB); Rifat Alchalabi, 93 Chetwood Ter., Fanwood, NJ (US) 07023

( * ) Notice: Subject to any disclaimer, the term of this patent is extended or adjusted under 35 U.S.C. 154(b) by 544 days.

(21) Appl. No.: 10/311,025

(22) PCT Filed: Jun. 19, 2001

(86) PCT No.: PCT/GB01/02700

§ 371 (c)(1),
(2), (4) Date: Dec. 11, 2002

(87) PCT Pub. No.: WO01/98092

PCT Pub. Date: Dec. 27, 2001

(65) Prior Publication Data

US 2003/0145482 A1 Aug. 7, 2003

(30) Foreign Application Priority Data

Jun. 19, 2000 (GB) ..... 0014800.7

(51) Int. Cl.
*F26B 17/12* (2006.01)

(52) U.S. Cl. ..... 34/168; 34/169; 34/187; 34/131; 34/132; 34/72; 110/210

(58) Field of Classification Search ..... 34/168, 34/169, 184, 187, 130–132, 164, 72; 110/241, 110/242, 101 R, 209, 210; 134/19; 451/32, 451/33, 35, 326, 328, 329; 432/117
See application file for complete search history.

(56) References Cited

U.S. PATENT DOCUMENTS

| | | | | |
|---|---|---|---|---|
| 2,290,036 | A | 7/1942 | Davis | 141/1 |
| 3,171,638 | A * | 3/1965 | Zimmerley et al. | 432/117 |
| 3,619,908 | A * | 11/1971 | Kallas | 34/132 |
| 4,941,822 | A * | 7/1990 | Evans et al. | 432/112 |
| 4,996,779 | A | 3/1991 | Nakagomi | 84/1 |
| 5,059,116 | A * | 10/1991 | Gillespie et al. | 432/106 |
| 6,601,315 | B2 * | 8/2003 | Stafford | 34/602 |

* cited by examiner

*Primary Examiner*—Jiping Lu
(74) *Attorney, Agent, or Firm*—Young Basile

(57) ABSTRACT

An apparatus for thermally de-coating and/or drying coated and/or contaminated materials comprises a support and an oven pivotally mounted to the support. The oven has charging portion for receiving material to be treated and a changeover portion. Incorporated within the changeover portion is a heat treatment chamber through which a stream of hot gasses can be passed. The oven is pivotally moveable between a first position in which the changeover portion is higher than the charging portion and a second position in which the charging portion is higher than the changeover portion. The arrangement is such that the oven can be repeatedly moved between the first and second positions so that material within the oven falls from one portion to the other portion, passing through the stream of hot gasses in the heat treatment chamber. A method of using the apparatus is also disclosed.

20 Claims, 8 Drawing Sheets

APPARATUS AND METHOD THERMALLY REMOVING COATINGS AND/OR IMPURITIES

FIELD OF THE INVENTION

This invention relates to apparatus and a method for thermally removing coatings and/or impurities from materials. In particular the invention relates to apparatus and a method for thermally removing coatings and/or impurities from materials which are particularly suited to batch processing of materials.

BACKGROUND OF THE INVENTION

There is an increasing requirement to recycle materials such as aluminum magnesium and other metals and non-metals. Often such materials will be coated in paint, oil, water, lacquers, plastics, or other volatile organic compounds (V.O.C.s) which must be removed prior to remelting the materials. For materials which are capable of being processed at relatively high temperatures without melting, such impurities are typically removed using a thermal process which is sometimes known as de-coating. Such thermal de-coating processes can also be used to dry and/or sterilize materials prior to remelting.

For example, aluminium is often used in the production of beverage cans which are typically coated in paint, lacquers and/or other V.O.C.s. Before used beverage cans (U.B.C.s) or scrap material produced during the manufacture of beverage cans can be melted down for recycling, any coatings or other impurities must be removed in order to minimize metal loss.

Thermal de-coating, however, is not limited to application to aluminium but can be used to clean or purify any metal or non-metallic materials which are capable of withstanding the temperatures present in the thermal de-coating process. Thermal de-coating can be used to de-coat or purify magnesium or magnesium alloys for example.

Known thermal de-coating processes involve exposing the material to be treated hot gases in order to oxidise the coatings and/or impurities which are to be removed. This exposure takes place in a closed environment in which the temperature and oxygen content of the hot gases can be controlled. Temperatures in excess of 300 C. are required to remove most organic compounds and an oxygen level in the range of 6% to 10% is normally required.

If the temperature and oxygen levels of the hot gases are not carefully controlled the process can go autothermic as the V.O.C.s which are released during the thermal stripping are combuted. This can result in an uncontrolled increase in the temperature of the hot gases which may be very dangerous.

The material will usually be shredded before treatment and it is important for effective de-coating that all the surfaces of the shredded material are exposed to the hot gases. If this does not occur then the treatment becomes less effective and, in the case of U.B.C.s in particular, a black stain may be left on the surface of the treated material. It is also desirable for the material to be agitated during the treatment to physically remove lose coatings or impurities from the material.

At present there are three main systems which are used for thermal de-coating, these are:

1. Static Oven

In static oven, the material is stacked on a wire mesh and hot gases are recirculated through the oven to heat the material to the required process temperature.

This arrangement is not efficient because the hot gases do not come in to contact with the materials that are enclosed within the stack of materials on the mesh. As discussed previously, it is important in de-coating that all the surfaces of the materials being treated are exposed to the hot gases. Also there is no agitation of the material being treated.

2. Conveying Oven

This system uses a mesh belt conveyor to transport materials for treatment through an oven. Hot gasses are passed through the material on the belt as it passes through the oven. The problems with this method are as follows:

- The depth of materials on the belt limits the process. The materials are stacked, causing similar problems to those found with the static oven in which materials at the centre of the stack do not come into contact with the hot gases
- There is no agitation of the materials, so loose coatings are not removed.
- The conveyor belt life is short.
- The materials have to be constantly fed.
- The process is not suitable for low volume or continuously changing product.

3. Rotating Kiln

A large kiln is inclined to the horizontal so that material fed or charged into the kiln at its highest end travels towards the lowest end, where it is discharged, under the influence of gravity. The kiln is rotated so that material within the kiln is agitated and a flow of hot gases is provided to heat up the material as it travels through the kiln. A number of problems are associated with this method:

- The material has to be constantly fed.
- The process is not suitable for low volume or continuously changing product.
- The continuous process requires air locks at both ends, materials charge end and materials discharge end.
- The kiln requires a rotating seal leading to a high level of maintenance.

SUMMARY OF THE INVENTION

It is an object of the invention to provide an improved apparatus for thermally de-coating and/or drying coated and/or contaminated materials which overcomes or at least mitigates the problems of the known thermal de-coating apparatus.

It is a further object of the invention to provide an improved apparatus for thermally de-coating and/or drying coated and/or contaminated materials which is suited to batch processing of materials.

It is a further object of the invention to provide an improved apparatus for thermally de-coating and/or drying coated and/or contaminated materials which has increased flexibility in the handling a wide selection of materials with various coatings compared with known apparatus.

It is a further object of the invention to provide an improved apparatus for thermally de-coating and/or drying coated and/or contaminated materials which requires less supporting equipment than the known apparatus.

It is a further object of the invention to provide a method of thermally de-coating and/or drying coated and/or contaminated materials which overcomes or at least obviates the disadvantages of the known methods.

It is a further objective of the invention to provide a method of thermally de-coating and/or drying coated or contaminated materials which is suited to batch processing of materials.

Thus, in accordance with a first aspect of the invention there is provided an apparatus for thermally de-coating and/or drying coated and/or contaminated materials, the apparatus comprising:

a support;

an oven mounted to the support and comprising a charging portion for receiving material to be treated and a changeover portion, the changeover portion incorporating a heat treatment chamber through which a stream of hot gasses can be passed;

the oven being moveable relative to the support between a first position in which the changeover portion is generally higher than the charging portion and a second position in which the charging portion is generally higher than the changeover portion;

the arrangement being such that, in use, the oven can be repeatedly moved between the first and second positions so that material within the oven falls, under the influence of gravity, from one portion to the other portion, passing through the stream of hot gasses.

In accordance with a second aspect of the invention, there is provided a method of thermally de-coating and/or drying coated and/or contaminated materials comprising:

providing an oven having charging portion for receiving material to be treated and a changeover portion, the changeover portion incorporating a heat treatment chamber through which a stream of hot gasses can be passed, the oven being movable between a first position in which the changeover portion is generally higher than the charging portion and a second position in which the charging box is generally higher than the changeover portion;

placing the material the oven;

repeatedly moving the oven between the first and second positions so that the material in the oven falls, under the influence of gravity, from the one portion to the other portion through the stream of hot gases.

BRIEF DESCRIPTION OF THE DRAWINGS

Several embodiments of the invention will know be described, by way of example only, with reference to the accompanying drawings in which.

DETAILED DESCRIPTION OF THE PREFERRED EMBODIMENTS

Figure 1:
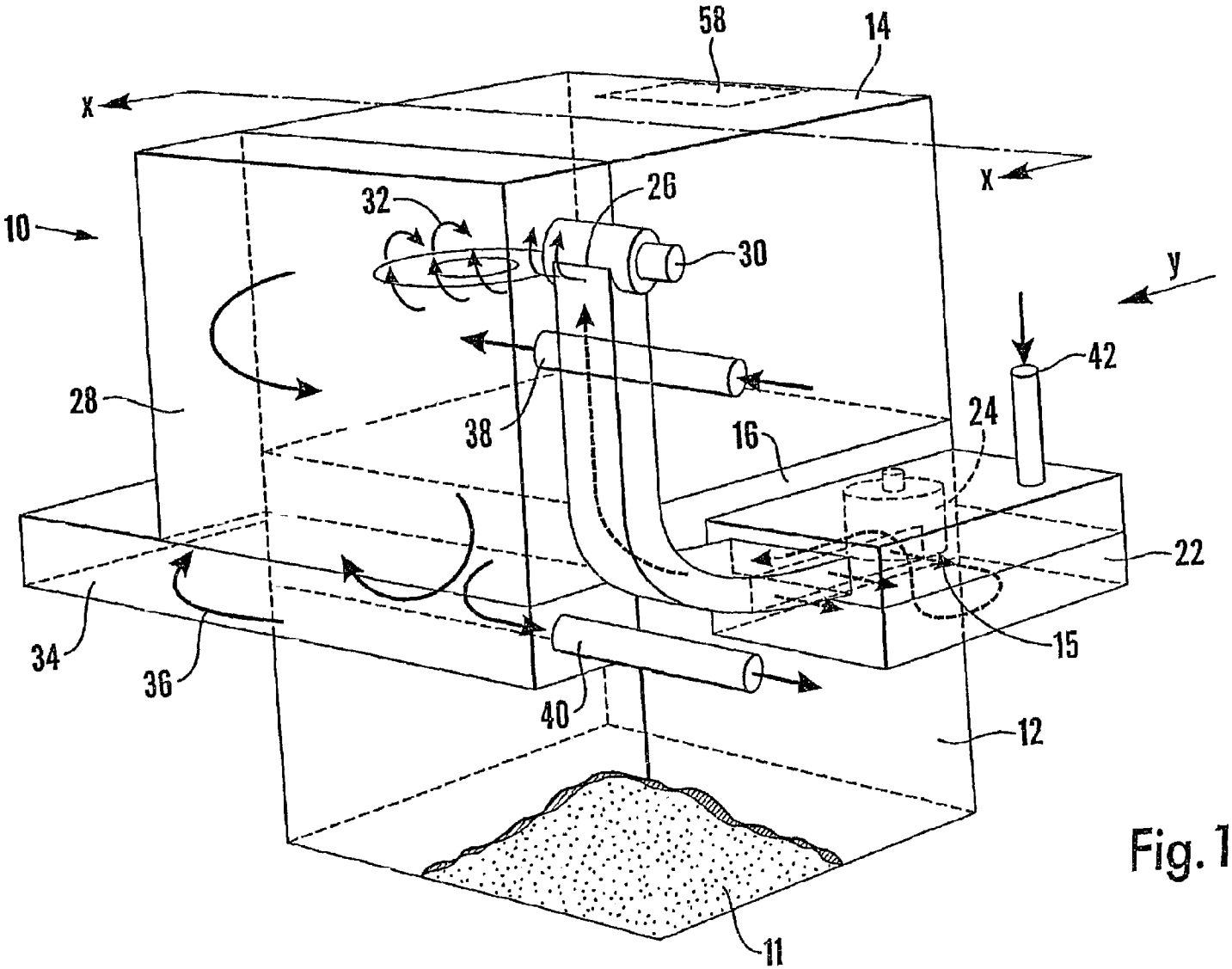
FIG. 1 is a schematic, perspective view of an oven of an apparatus in accordance with the invention.
Figure 2:
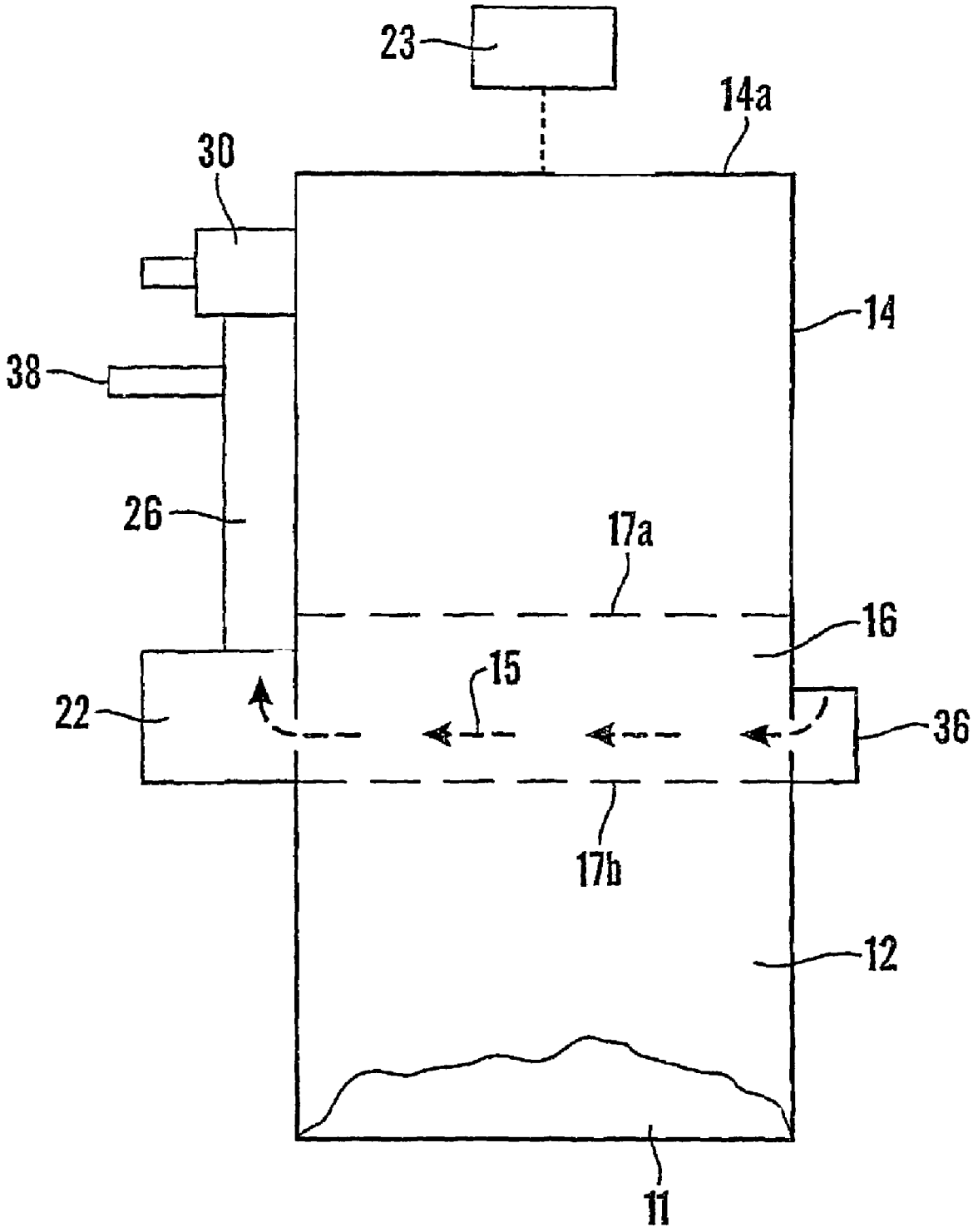
FIG. 2 is a cross sectional view through the oven of FIG. 1 taken along the line X-X.

Referring to FIGS. 1 to 3, there is shown an oven, indicated generally at 10, which forms part of an apparatus for thermally de-coating and/or drying coated and/or contaminated materials.

The oven 10 comprises a charging portion or box 12 for initially receiving the material 11 to be treated and a changeover portion 14. Incorporated within the changeover portion is a heat treatment chamber 16 through which a stream of hot gasses 15 can be passed from one side of the oven to the other.

On one side of the oven is a recirculation chamber 22 in to which the gasses are drawn from the treatment chamber 16 by a recirculating fall 24. An air mixing jacket 26 guides the gases from the recirculation chamber 22 into an afterburner chamber 28 in which the gasses are heated by a burner 30. The walls of the afterburner chamber 28 can be air cooled stainless steel walls or may be lined with a suitable refractory material.

The burner 30 which heats the gasses may be designed to run on either a gaseous or a liquid fuel or both. In a preferred embodiment the burner is also designed so as to be able to burn the V.O.C.s which are thermally stripped from the materials in the treatment chamber 16. These V.O.C.s are drawn out of the treatment chamber 16 with the gases 15 by the recirculating fan 24 and are mixed with the air in the mixing jacket 26. The air mixing jacket 26 is designed to ensure that the gasses enter the afterburner with a helical flow, as indicated by the arrows 32, which ensures that V.O.C.s have a maximum residence time and exposure to the hot zone of the burner flame.

By burning the V.O.C.s the overall thermal efficiency of the oven is increased since less fuel need be supplied to heat the gases 15 to the required operating temperature. If sufficient V.O.C.s are present, no additional fuel need be added to heat the gases to the required temperature so that the process can operate autothermically.

Burning the V.O.C.s also improves the control of emissions by removing these pollutants from the re-circulating gases and reducing the need for further and expensive treatment of gases which are exhausted from the afterburner chamber as will be described later.

From the afterburner chamber 28, the hot gases enter a pre-treatment chamber 34 from where they enter a restricted passage 36. The restricted passage 36 feeds the hot gasses into the treatment chamber 16 on the opposite side of the oven from the recirculation chamber 22.

It should be noted that in this embodiment, the heat treatment chamber 16 extends only over a partial region of the changeover portion. The upper and lower (as shown in FIG. 2) boundaries of the heat treatment chamber 16 being indicated by the dashed lines 17*a* and 17*b* in FIG. 2. As shown in FIG. 2, the lower boundary 17*b* of the heat treatment chamber is substantially in the same plane as the lower edge of the changeover portion 14, whilst the upper boundary 17*a* lies partway up the changeover portion 14. However, in alternative embodiments, the heat treatment chamber could extend over the full height or extent of the changeover portion so that the upper boundary 17*a* coincides with the top 14*a* of the changeover portion. In such an arrangement, the whole of the changeover portion is effectively a heat treatment chamber. The recirculating chamber 22 and the passage 36 being extend as required.

A control system (indicated schematically at 23 in FIG. 2) monitors and controls the level of oxygen and the temperature of the gases in the treatment chamber 16 to ensure the system operates within safe and effective limits for thermal de-coating of the material being treated. Typically, the oxygen level will be maintained below 16% whilst temperatures in excess of 300 C are required to remove most organic compounds. A lance 38, regulated by the control system, supplies fresh air into the afterburner chamber 28 so as to control both the required level of oxygen and temperature of the gases. The afterburner chamber 28 exhausts combustion gases through an exhaust pipe 40. The flow of exhaust gases being controlled via temperature and pressure controlled damper (not shown).

An auxiliary fresh air inlet 42 is also provided in the recirculation chamber 22. The auxiliary inlet 42 allows air to enter the recirculation chamber to mix with the hot gases and to cool the fan 24. The control system monitors the temperature of the fan and operates a valve to control the flow of air through the auxiliary inlet to maintain the temperature of the fan below its maximum permitted operating temperature. The control system balances the flow of air through the lance 38 and the auxiliary inlet 42 in order to maintain the required oxygen content and temperature of the gases in the treatment chamber 16.

Figure 3A:
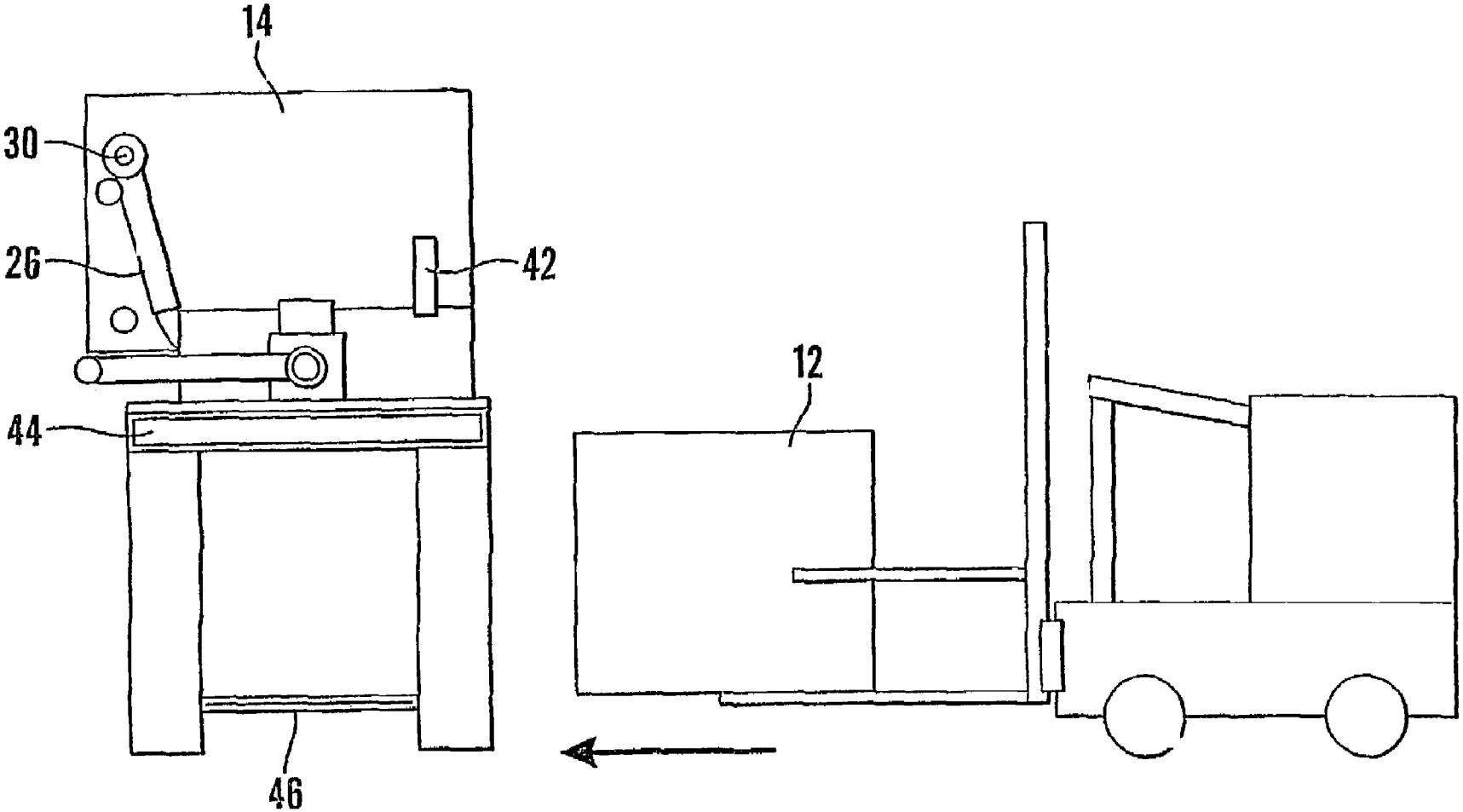
FIGS. 3*a*-3*g* are a series of schematic diagrams showing the various phases of operating cycle of an apparatus in accordance with the invention comprising the oven of FIG. 1.

The oven 10 is pivotably mounted to a support structure 44 having a base frame 46 (see FIG. 3*a*). As shown in FIGS. 3*b* to 3*f*, the oven can be moved between a fist position 3*b* in which the changeover portion 14 is higher than the charging box 12 and a second position 3*d* in which the charging box 12 is higher than the changeover portion 14.

Means (not shown) are provided for automatically moving the oven between the first and second positions under the control of the control system for the apparatus. This means can be of any suitable form and may for example comprise one or more electric or hydraulic motors. The motors may act through a gearbox if required. Alternatively the means may comprise one or more hydraulic or pneumatic rams. The means could also comprise a combination of motors and rams.

In a preferred embodiment, the charging box 12 is removably mounted to the oven. This conveniently enables materials to be loaded into and removed from the charging box 12 at a location separate from the oven. The charging box 12 once attached to the oven becomes an integral part of the structure of the oven and hence rotates with the oven so that material is transferred into and out of the charging box, and through the treatment chamber 16. Preferably the charging box 12 is adapted for removal using a fork lift truck or any other suitable means for transporting the charging box to and from the oven.

The charging box may be attached to the changeover portion by any suitable means (not shown). For example the charging box may be attached using one or more clamps, which could be automatically controlled, or may be attached by means of fastenings such a bolts. A seal (not shown) maybe provided between the charging box and the remainder of the oven to ensure that interior of the oven is fully sealed in use.

Operation of the apparatus will know be described with reference to FIGS. 3*a* to 3*f* in particular.

Figure 3B:
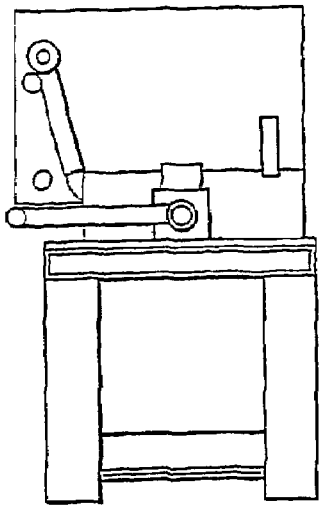
Figure 3C:
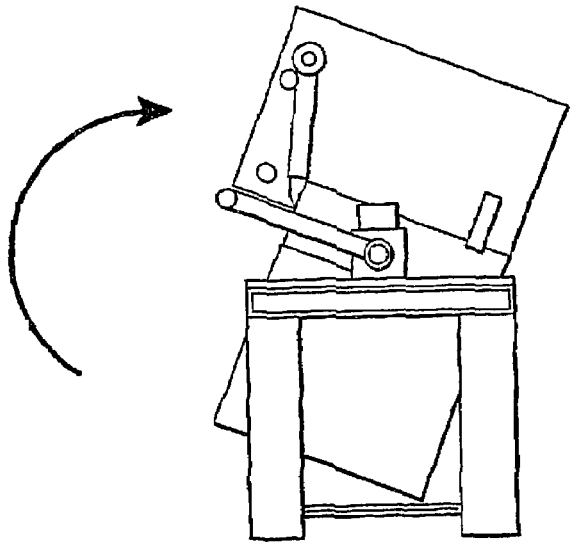
Figure 3D:
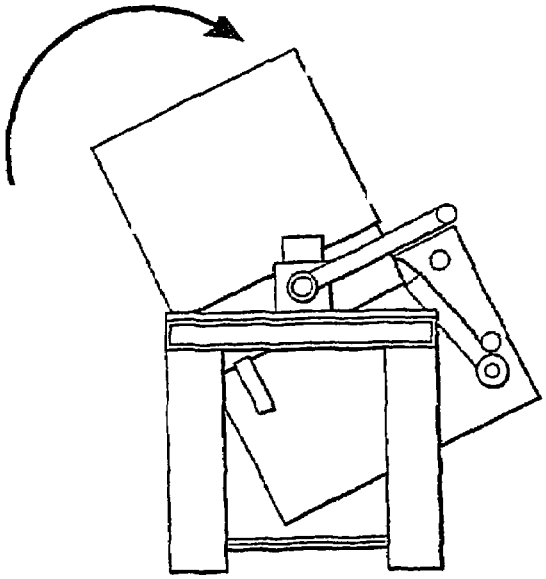

The material to be processed is loaded into the charging box 12 which is then transported to the oven by means of a fork lift truck. Once the charging box 12 is in position it is locked to the oven and the fork lift truck removed. The treatment process can then be initiated under the control of the control system The gases passing through the treatment chamber 16 are heated and the oven rotated from the first position as shown in FIG. 3*b* until it reaches the second position shown in FIG. 3*d* in which the oven is nearly inverted.

As the oven is rotated, the materials in the charging box 12 will fall under the influence of gravity into the changeover portion 14 passing through the stream of hot gases in the is treatment chamber 16. It should be noted that the material passes through the stream of hot gases 15 transversely to the direction of flow of the hot gases through the treatment chamber 16.

Figure 3E:
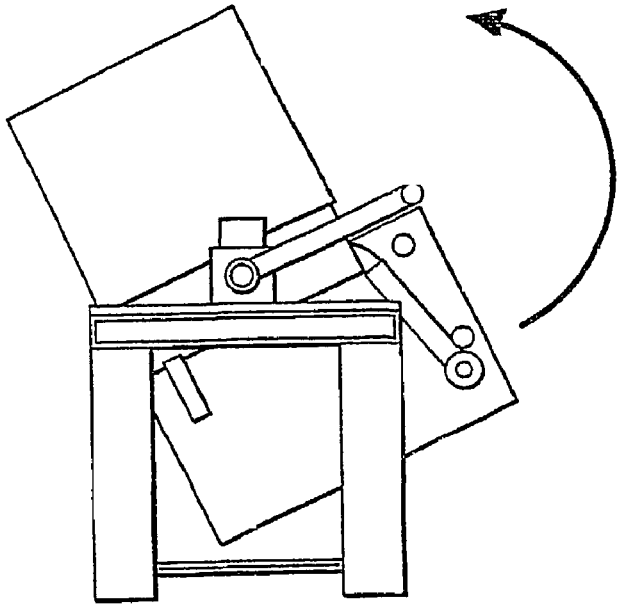
Figure 3F:
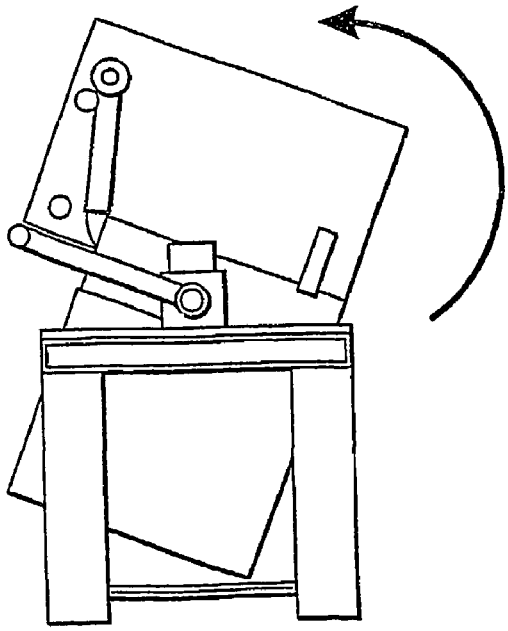

The rotary movement of the oven can then be reversed, as shown in FIGS. 3*e* and 3*f*, until the oven is returned to the first position. During this reverse rotary movement, the materials will fall from the changeover portion 14 into the charging box 12, again passing through the stream of hot gases 15. The rotational movement of the oven between the first and second positions is repeated a number of times as required by the process control until the material 11 is fully treated.

The treatment process goes through a number of phases or cycles: a heating cycle during which the hot gases and the materials are brought up to the required treatment temperature, a treatment cycle in which the temperature of the gasses and materials is maintained at the treatment temperature, and finally a cooling cycle during which the temperature of the gases and the treated material is brought down to a level at which the material can be safely removed.

Figure 3G:
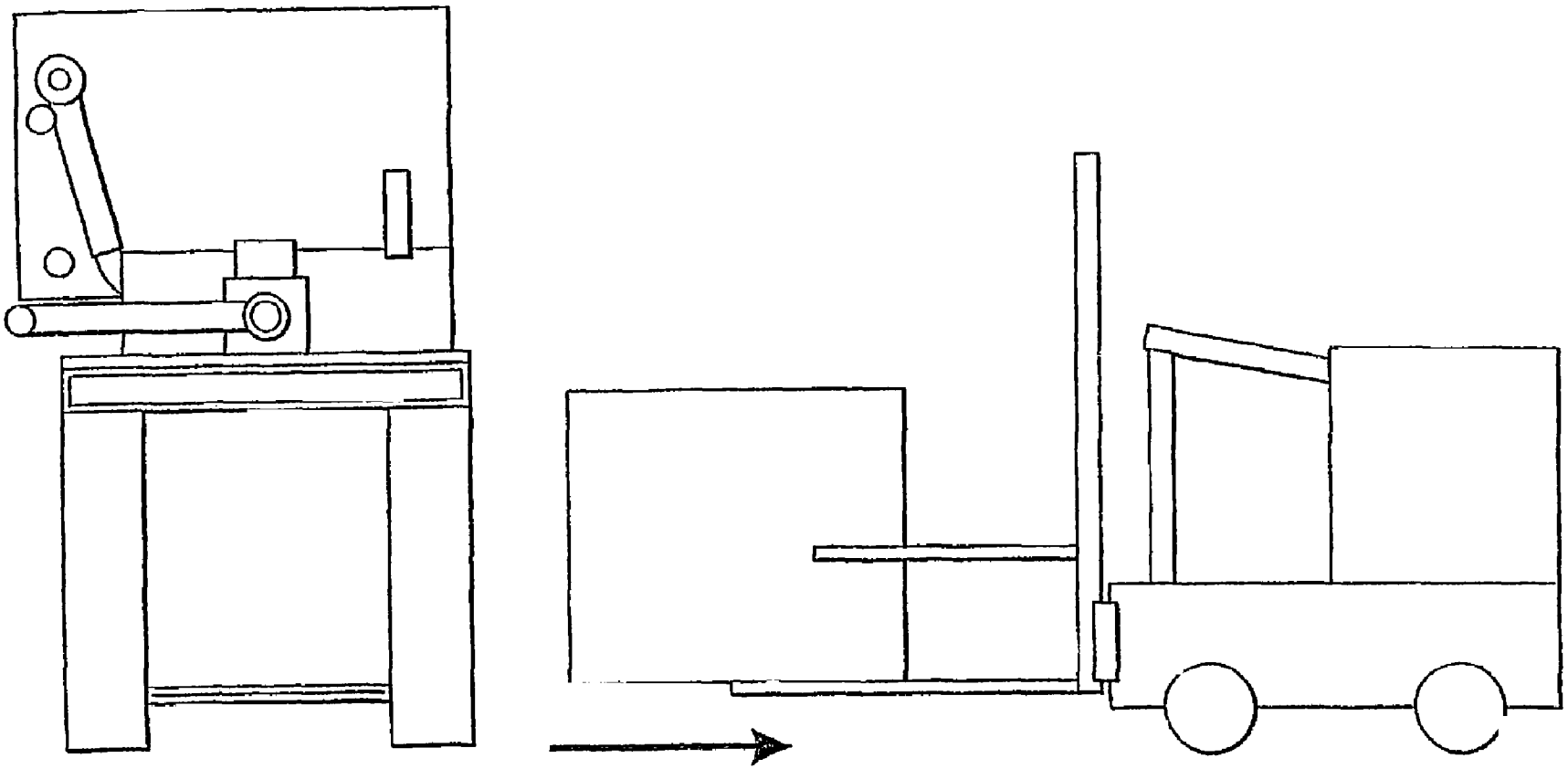

Once the treatment process is completed, the oven is returned to the first position and the charging box 12 removed, as shown in FIG. 3*g*, so that the treated material can be transported for cooling, storage or further processing as required.

The rotary motion of the oven ensures that the material to be treated passes through the stream of gases in the treatment chamber in a controlled manner. The falling action of the material also ensures that all the surfaces of the material become fully exposed to the gases promoting an efficient and effective de-coating and/or decontamination.

The control system 23 controls the speed and frequency of the rotary movement of the oven along with the temperature and oxygen level of the gases in order to oxidize coatings or impurities on the material 11 whilst ensuring the process is carried out safety and efficiently with minimum loss of the material being treated.

A particular feature of the apparatus is the ability for the system to stop the rotary motion of the oven at any time. This can be particularly useful when treating heavily coated materials to ensure that the temperature in the afterburner does not increase in an uncontrolled manner due to the high level of V.O.C.s present in the gases. When the apparatus stops rotating, the amount of combustible material in the gases is reduced and the combustion process slows down and hence the temperate drops back to the controlled level. As the temperature returns to acceptable levels, the apparatus resumes rotation and the treatment process continues. This ability to stop the rotation of the oven ensures a controlled volatile release throughout the treatment process. The combustion process can be further slowed down by stopping the oven in a position in which the material drops into the charging box 12. This ensures the material is out of the gas flow and away from the hot surfaces of the changeover portion.

Figure 4:
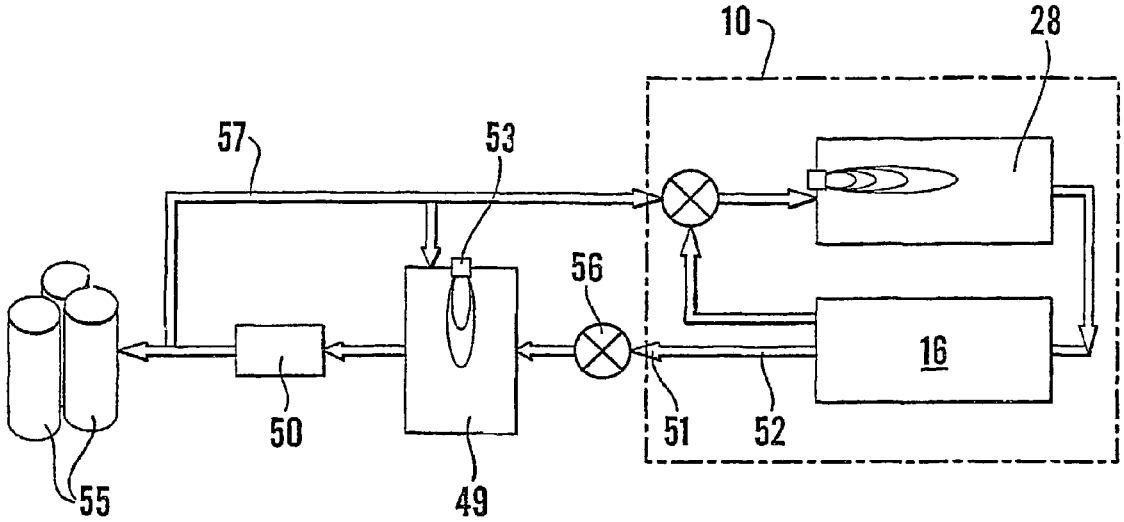
FIG. 4 is a schematic diagram of a modified apparatus in accordance with the invention having a second after burner.

In addition to the ability to stop the rotary motion of the oven and so reduce the rate of V.O.C. release, for cases where heavily coated materials need treatment, the apparatus could be equipped with a second afterburner system 49 and a separate cooling system 50 as shown schematically in FIG. 4. The second afterburner system 49 can be located next to the rotating oven 10 and is connected via stainless steel or insulated ducts 51 that transfer hot gases with the volatiles 52 from the treatment chamber 16 into the second afterburner 49.

Inside the second afterburner 49 the volatiles are incinerated with the aid of a second burner 53. The exhaust gasses from the second afterburner 49 are cooled in a separate cooling system 50 which may be located adjacent the second afterburner system 49. After passing through the cooling unit 50, most of the exhaust gasses are passed to an air pollution control unit 55 such as a bag or reverse jet filtration system. However, some of the exhaust gases, which now contain no fuel or oxygen and so are inert, can be recirculated back into the first afterburner chamber 28 and/or the second afterburner 49 via further ducts 57 in order to help reduce the combustion process further.

The cooling system 50 uses indirect cooling, for example a heat exchanger system, to provided a controlled cooling which yields a temperature level that is acceptable to the air pollution control unit 55, and to the afterburner chamber 28. The hot gasses are circulated through the second afterburner 49 and the cooling system 50 by a second recirculating fan 56.

In addition to the rotary movement of the oven, the apparatus may be provided with means, such as an electro/mechanical vibrator (not show), for vibrating the oven or at least a part of the oven. The vibration means can also be controlled by the control system 23. This additional vibrating action allows the apparatus to transfer the materials between he charging box 12 and the changeover portion 14 in a finer and more controlled quantity to promote a better exchange between the hot gases and the material.

The vibration motion can also be used to facilitate mechanical stripping of the coating and contaminates from the material 11. For example, the arrangement can be such that the material is vibrated at a frequency which is equal or close to its natural or resonance frequency. Alternatively, the oven (or at least parts of the oven such as the charging box 12 and/or the changeover portion 14) can be vibrated at its natural or resonance frequency. Hence allowing the material to vibrate efficiently which increases the abrasion forces and allows the gases to penetrate and treat the material 11.

Figure 5:
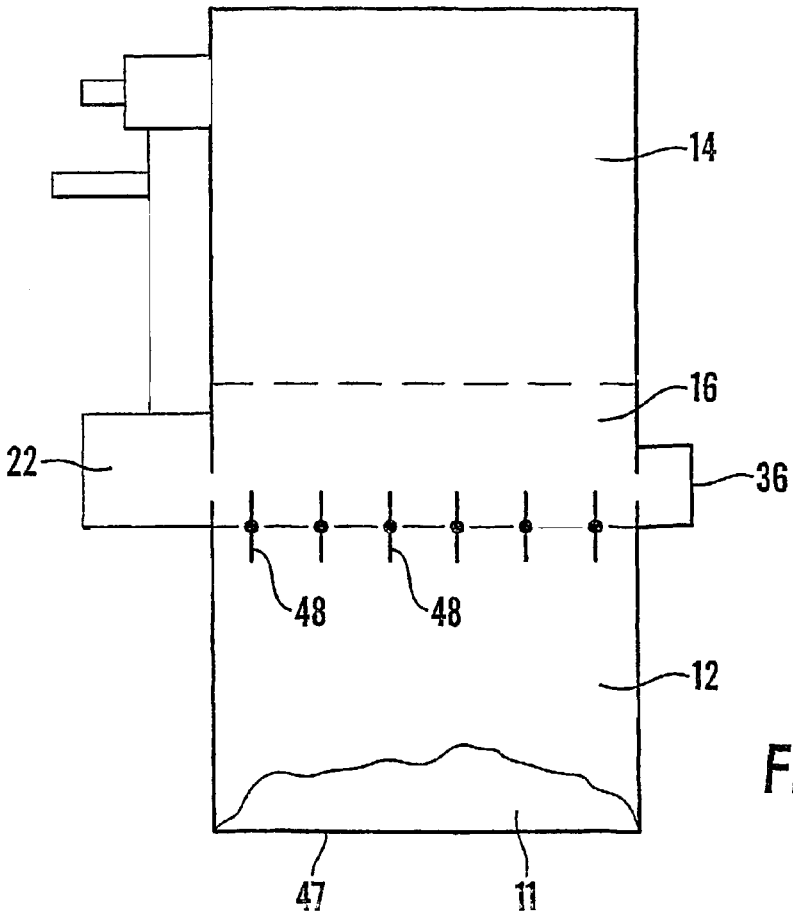
FIG. 5 is a view similar to that of FIG. 2 showing a modification to the oven of FIG. 1; and, FIG. 6 is a front elevation of the oven of FIG. 1 taken in the direction of arrow Y but showing a modification in which a removable cassette portion is provided between a charging box and a changeover portion of the oven.

FIG. 5 shows a modification to the oven 10 in which a number of shutters or dampers 48 are provided between the charging box 12 and the changeover portion 14. In the present embodiment the dampers 48 comprise elongate flap members which extend across the width of the changeover portion. The flaps can be pivoted between an open position as shown in FIG. 5 and a closed position in which the flaps are aligned substantially parallel to the base 47 of the charging box 12 and co-operate to close off the charging box 12 from changeover portion. The dampers 48 are interconnected by a shaft (not shown) which ensures that all the dampers operate in a unified motion for movement between the open and closed positions.

The dampers 48 are operated automatically by the control system 23 in accordance with the process requirements and can be used to provide a dynamic heating volume within the oven by selectively isolating the charging box 12 from the changeover portion 14 as described below.

During the heating cycle, the dampers can be closed to trap the material within the changeover portion 14. This leads to a shortened heating cycle by increasing the heat transfer rate into the materials. This is because the hot gases are forced to pass through the material trapped in the treatment chamber 16 as the gases traverse across the oven. Furthermore, the charging box 12 will typically have less insulation than the changeover portion 14, so isolating the charging box 12 during the heating cycle reduces heat loss.

Once the heating cycle has been completed the dampers 48 can be opened to increase the heating volume and to allow the material 11 to pass between the charging box 12 and the changeover portion 14 in the normal way during the treatment and cooling phases.

The dampers can also be used in a partially closed position, for example at 45 degrees, to provide a restricted movement of the material between the charging box 12 and changeover portion 14. This allows better control of the de-coating process as the maternal passes through the partially opened flaps.

Alternatively the dampers can be closed to trap the material in the charging box 12 so that it is isolated fully from the hot gasses in the treatment chamber 16. This may be useful in controlling the autothermic combustion of V.O.C.s.

The apparatus in accordance with the invention is particularly suited for treatment of relatively small quantities of material of up to 2 Tons per cycle. This enables a cost effective treatment of materials on much smaller scales than the known rotary kiln or conveying oven apparatus but without the drawbacks of the static oven. Because the materials are processed in batches, the apparatus can be adapted to treat a variety of materials by resetting of the control system between batches.

The apparatus according to the invention can be made relatively small compared with the known rotary kilns or conveying ovens and so takes up much less floor space. The apparatus in accordance with the invention is also relatively simple and requires less maintenance than the known apparatus.

A further advantage of the apparatus in accordance with the invention is that it requires less supporting equipment than the known rotary kiln and conveying oven apparatus which typically require in feed conveyor belts, discharging conveyor belts, and storage hoppers to maintain a continuous operation.

The apparatus as described above can be modified in a number of ways. For example, a jet stirring system (not shown) can be provided to agitate and stir the material in the heat treatment chamber. This allows the hot gases in the heat treatment chamber to reach more of the material being treated and so improves the efficiency of the process. Such a system may comprise one or more jets which can emit a constant stream or blasts of a gaseous material to stir the material in the heat treatment chamber. The gaseous material may be fresh air and may form part of the control system for controlling the oxygen and temperature levels in the oven. Alternatively, the gaseous material can be part of the gases 15 recirculating about the oven.

Figure 6:
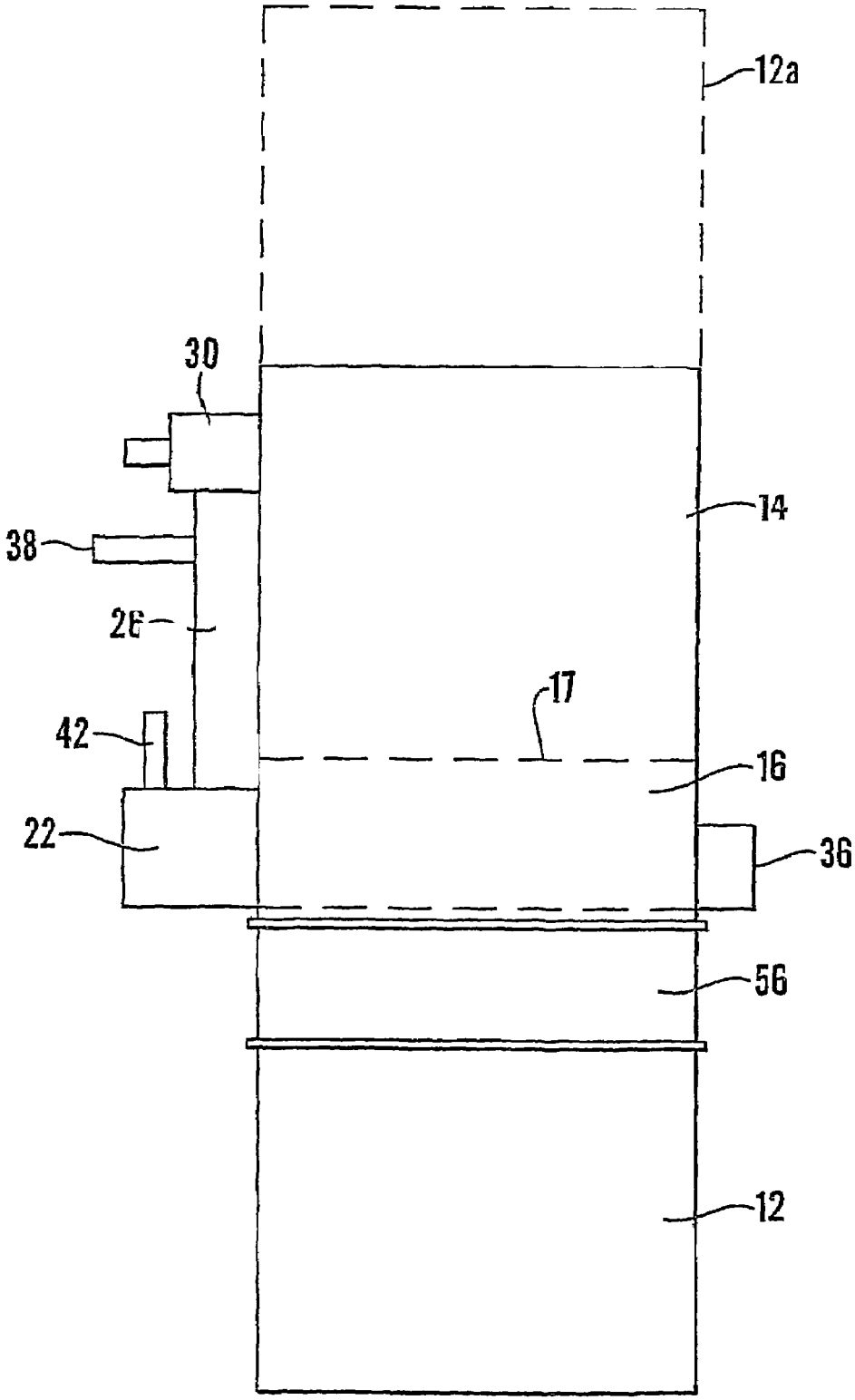

It is also possible to incorporate one or more tools (not shown) into the apparatus in order to carry out further treatment or control of the material in the oven. In a particularly preferred embodiment shown in FIG. 6, such tools can be located between the charging box 12 and the changeover portion 14 in a removable cassette portion 56 which can be adapted to hold one or more such tools. The use of a removable cassette 58 in this way allows for a quick and easy change or removal of the tooling between batches.

Examples of the type of tools (not shown) which may be incorporated into the cassette 58 include:

A shredding means for shredding the material as is drops from the charging box to the changeover portion. Such a shredding means may be a rotary shear shredder or any other suitable form of shredder known in the art.

Alternatively or in addition, the cassette 58 may hold an electromagnetic non-ferrous metal separator for separating non-ferrous metals from the rest of the material being treated. The separator acts on the material passing between changeover portion and the charging box. Typically such a separation will be carried out towards the end of the cooling cycle of the process and the non-ferrous metal will be collected in a separate bin from the rest of the material. The separator may be of any suitable type such as those which are known in the art A feeding means may also be provided in the cassette 58 to control the movement of the material between the charging box and change over portion. The feeding means may comprise a damper system similar to that described above in relation to FIG. 5 or any other suitable system for controlling the release of material from the charging box 12. The use of such a feeding means allows material to be slowly released from the charging box 12 into the changeover portion 14 for treatment in a substantially continuous manner. This can be useful controlling the release of V.O.C.s.

Although not shown in the drawings, other tools for treating or preparing the material could be provided in the charging box 12 itself. For example the charging box 12 could comprise a spin drying system, a pre-heating system, a mechanical stirring system, a mechanical washing system, a pressing system, and/or a bracketing system. Such systems being well known in the art.

As an alternative to using a fork lift truck to load and unload the charging box 12 to and from the oven, an automated charging and discharging system (not shown) can be used. Such a system may comprise conveyor belts and feeding hoppers to load material to be treated into an empty charging box 12. The charging box 12 will then be brought to the oven and attached automatically so that treatment can commence. After treatment the charging box is automatically removed from the oven and the contents emptied onto a further conveyor belt system to be taken for further processing or storage. The system may use a number of charging boxes 12 for each oven with different boxes being at different stages in the overall process.

In certain circumstances, it may be preferable to have a separate box or bin for receiving the treated material at the end of the process rather than the treated material being returned to the charging box 12. For example such an arrangement may be useful in preventing re-contamination of the treated material from the charging box. In these circumstances, a discharge means, such as an automatically controlled sliding door (indicated in dashed lines at 58 in FIG. 1), can be provided in the changeover portion 14 through which the treated material 11 can be discharged from the oven. In this arrangement, the material to be treated is loaded to the oven in a charging box 12 as previously described. However, at the end of the treatment process, the oven is inverted and the door 58 opened so that the treated material is tipped into a separate bin, which is used only for treated materials. Once this process is completed, the oven is returned to its normal starting position and the charging box 12 removed and a new charging box 12 with a further batch of material to be treated attached in its place. The loading and unloading of the charging box 12 can be automated as described above.

In a yet further embodiment a second charging box (indicated by dashed lines at 12*a* in FIG. 6) can be provided on the opposite side of the changeover portion 14 from the first charging box 12 and means, such as a damper system as described above in relation to FIG. 5, can be provided between each charging box 12, 12*a* and the changeover portion 14. This arrangement allows two charging boxes, each containing material to be treated, to be loaded to the oven and the material in each box processed sequentially. So for example, a first charging box 12 with material to be treated can be attached to one side of the changeover portion 14 with the dampers adjacent the first box closed to trap the material within the first charging box 12. The oven can then be inverted and a second charging box 12*a*, containing a further batch of material to be treated, attached to the opposite side of the changeover portion with the damper system adjacent the second box also closed. The oven can then be started and the material from one of the charging boxes 12*a* processed by opening the damper system adjacent that box to allow the material in that box to enter the changeover portion in the normal way. Once the first batch of material has been processed, the oven is positioned so that the treated material is returned to its charging box 12*a* and the dampers closed. The process can then be repeated for the material in the other charging box 12. Once the material in both charging boxes has been treated, both charging boxes 12, 12*a* can be removed and replaced by further boxes containing material for treatment. This arrangement can be used to reduce down time between batches and so increase the throughput of material.

The invention claimed is:

1. Apparatus for thermally de-coating and/or drying coated and/or contaminated materials in a batch process, the apparatus comprising:

a support having mounting means;

an oven pivotally mounted to the support at the mounting means and pivoting through an arc about an axis formed by the mounting means between a reciprocal first position and a second position relative to the mounting means, the oven comprising:

a heat treatment chamber;

a burner;

a recirculation fan;

a recirculation chamber;

a changeover portion; and a transportable charging portion for carrying the materials from a remote location to the changeover portion;

the changeover portion having an open end, an opposing closed end, and an interior with the heat treatment chamber disposed therein and the burner and the recirculation fan and the recirculation chamber attached to the change over portion, said heat treatment chamber disposed between the open end and the opposing closed end of the changeover portion, through which a stream of hot gases heated by the burner are passed, said recirculation fan subsequently passing the gases to the recirculation chamber, said charging portion removably mounted to the change over portion enclosing the open end allowing the materials contained within the charging portion to fall through the open end and through the heat treatment chamber into the interior of the changeover portion in response to the oven pivoting about the axis through the arc.

2. Apparatus as claimed in claim 1, in which the heat treatment chamber extends over a partial region of the changeover portion.

3. Apparatus as claimed in claim 1, in which the heat treatment chamber extends over the full extent of the changeover portion from the open end to the opposing closed end.

4. Apparatus as claimed in claim 1, further comprising control means for controlling the speed and frequency of the pivotal movement of the oven between the first and second positions, and for controlling the temperature and oxygen levels of the gases in the heat treatment chamber.

5. Apparatus as claimed in claim 1, in which the oven further comprises a first afterburner chamber with the burner for recirculating the gases through the treatment chamber via the first afterburner chamber.

6. Apparatus as claimed in claim 5, in which the burner is adapted to heat gases in the first afterburner chamber, and to combust volatile organic compounds present in the recirculating gases as a result of the thermal de-coating of the material passing through the treatment chamber.

7. Apparatus as claimed in claim 6, further comprising a control means for controlling the temperature and oxygen levels of the stream of gases in the treatment chamber in which the control means is adapted to stop the movement of the oven in order to control the combustion of volatile organic compounds.

8. Apparatus as claimed claim 5, in which the oven further comprises means for enabling fresh air to be introduced into the recirculating gases.

9. Apparatus as claimed in claim 5, further comprising a second afterburner chamber and a cooling means, the arrangement being such that a part of the recirculating gases can be passed through the second afterburner chamber and the cooling means before being returned to the first afterburner chamber in which the burner is adapted to heat gases in the first afterburner chamber, and to combust volatile organic compounds present in the recirculating gases as a result of the thermal de-coating of the material passing through the treatment chamber.

10. Apparatus as claimed in claim 1, further comprising means to vibrate the oven or a part of the oven.

11. Apparatus as claimed in claim 10, in which the means to vibrate the oven or a part of the oven is adapted such that the material being treated can be vibrated at a frequency which is equal to or close to the natural resonance frequency of the material, or equal to or close to the natural frequency of the oven or part.

12. Apparatus as claimed in claim 1, further comprising a removable cassette portion wherein said cassette portion can be located between the charging portion and the changeover portion, the removable cassette being adapted to hold one or more tools for treating or controlling the material as it passes between the charging portion and the changeover portion.

13. Apparatus as claimed in claim 1, further comprising one or more gas jets adapted to emit a stream or blast of a gaseous material for stirring or agitating the material in the heat treatment chamber.

14. Apparatus as claimed in claim 1 further comprising an automatic charging and discharging system having means for delivering and attaching to the oven a charging box loaded with material to be treated and for detaching the charging box from the oven and removing the detached charging box from the immediate vicinity of the oven.

15. Apparatus as claimed in claim 1, further comprising a discharge means, located in the changeover portion through which treated material can be discharged from the oven.

16. Apparatus as claimed in claim 15, wherein the discharge means includes a door.

17. Apparatus as claimed in claim 1, in which the charging portion comprises additional tooling for treating the material wherein the additional tools for treating the material includes at Least one of: means for spin drying the material, means for preheating the materials, means of mechanically stirring the material, means for washing the material, means for pressing the material, and means for bricketing the material.

18. Apparatus as claimed in claim 1, wherein the oven reciprocally rotates essentially 180° between the first and second positions.

19. Apparatus for thermally de-coating and/or drying coated and/or contaminated materials in a batch process, the apparatus comprising:

A support having mounting means for pivotally mounting a body to said support;

An oven pivotally mounted to the support at the mounting means for pivotal movement relative to the support, said oven comprising;

a changeover portion having an open end, an opposing closed end and an interior therebetween;

a heat treatment chamber disposed in the interior of the changeover portion between the open end and the opposing closed end;

a burner;

a recirculation fan, said burner and recirculation fan attached to the changeover portion providing heated gases passing through the heat treatment chamber; and a charging portion having a second interior with a closed base, said charging portion connected to the changeover portion at the open end with attachment means and selectively removable from the changeover portion for carrying the materials in the second interior from a remote location to the changeover portion for batch processing in the oven, wherein the oven pivots reciprocally through an arc between a first position when the changeover portion, heat treatment chamber, recirculation fan and burner are higher than the charging portion and a second position when the changeover portion, heat treatment chamber, recirculation fan and burner are lower than the charging portion allowing the materials to pass reciprocally through the heat treatment chamber to the base in the charging portion and to the opposing closed end in the changeover portion.

20. Apparatus as claimed in claim 19, wherein the heat treatment chamber extends only in the changeover portion.

* * * * *

UNITED STATES PATENT AND TRADEMARK OFFICE

CERTIFICATE OF CORRECTION

PATENT NO. : 7,331,119 B2
APPLICATION NO. : 10/311025
DATED : February 19, 2008
INVENTOR(S) : Ophneil Henry Perry et al.

It is certified that error appears in the above-identified patent and that said Letters Patent is hereby corrected as shown below:

Title Page Col. 1 (Title), Line 1; After “METHOD” insert -- FOR --.

Column 1 (Title), Line 1; After “METHOD” insert -- FOR --.

Column 1, Line 19 (Approx.); Delete “aluminum” and insert -- aluminum, --, therefor.
Column 1, Line 44 (Approx.); After “treated” insert -- to --.
Column 1, Line 55 (Approx.); Delete “combuted” and insert -- combusted --, therefor.
Column 2, Line 5 (Approx.); After “In” insert -- a --.
Column 4, Line 16; Delete “fall” and insert -- fan --, therefor.

Column 5, Line 26; Delete “fist” and insert -- first --, therefor.
Column 5, Line 55; Delete “maybe” and insert -- may be --, therefor.
Column 5, Line 65; After “system” insert -- . --.
Column 6, Line 6; After “the” delete “is”.
Column 6, Line 42; Delete “safety” and insert -- safely --, therefor.
Column 6, Line 52; Delete “temperate” and insert -- temperature --, therefor.
Column 7, Line 26; Delete “(now show)” and insert -- (not shown) --, therefor.
Column 7, Line 30; Delete “he” and insert -- the --, therefor.
Column 8, Line 12; Delete “maternal” and insert -- material --, therefor.
Column 9, Line 13; Delete “change over” and insert -- changeover --, therefor.
Column 9, Line 20; After “useful” insert -- in --.
Column 10, Line 46; in Claim 1, delete “change over” and insert -- changeover --, therefor.
Column 10, Line 52; in Claim 1, delete “change over” and insert -- changeover --, therefor.

UNITED STATES PATENT AND TRADEMARK OFFICE

CERTIFICATE OF CORRECTION

PATENT NO. : 7,331,119 B2
APPLICATION NO. : 10/311025
DATED : February 19, 2008
INVENTOR(S) : Ophneil Henry Perry et al.

It is certified that error appears in the above-identified patent and that said Letters Patent is hereby corrected as shown below:

Column 12, Line 9; in Claim 17, delete "Least" and insert -- least --, therefor.
Column 12, Line 24; in Claim 19, delete "comprising;" and insert -- comprising: --, therefor.

Signed and Sealed this

Twenty-fourth Day of June, 2008

JON W. DUDAS
*Director of the United States Patent and Trademark Office*